United States Patent [19]

Stanley et al.

[11] Patent Number: 4,675,118

[45] Date of Patent: Jun. 23, 1987

[54] QUATERNARY AMMONIUM SALTS USEFUL AS FABRIC SOFTENERS

[75] Inventors: Keith D. Stanley, Decatur; Kenneth B. White, Schaumburg, both of Ill.

[73] Assignee: Akzona Incorporated, New York, N.Y.

[21] Appl. No.: 816,638

[22] Filed: Jan. 6, 1987

Related U.S. Application Data

[63] Continuation-in-part of Ser. No. 516,140, Jul. 21, 1983, Pat. No. 4,569,800.

[51] Int. Cl.[4] ..... D06M 13/46; C07C 87/127

[52] U.S. Cl. ..... 252/8.8; 260/501.15; 564/291

[58] Field of Search ..... 260/501.15; 564/291; 252/8.8

[56] References Cited

U.S. PATENT DOCUMENTS

| | | | |
|---|---|---|---|
| 3,803,137 | 4/1974 | Egan et al. | 260/576.6 |
| 4,214,998 | 7/1980 | Joy | 252/8.8 |
| 4,341,644 | 7/1982 | Bisschops | 252/8.8 |

*Primary Examiner*—Glennon H. Hollrah
*Assistant Examiner*—Raymond Covington
*Attorney, Agent, or Firm*—Francis W. Young; Louis A. Morris; Jeffrey S. Boone

[57] ABSTRACT

A novel compound comprising a quaternary ammonium salt having the formula:

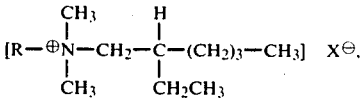

wherein R- is an aliphatic hydrocarbon radical having a carbon chain length of from about 6 to about 18, and $X^{\ominus}$ is $Cl^{\ominus}$, $I^{\ominus}$, $Br^{\ominus}$, or $OSO_3CH_3^{\ominus}$. The compound is soluble in water and/or isopropyl alcohol to form a true solution, which is clear and colorless at 70° F. and which has particular utility as a fabric softening composition. The compound remains as a solution in water even at composition/water weight ratios of 75:25.

13 Claims, No Drawings

QUATERNARY AMMONIUM SALTS USEFUL AS FABRIC SOFTENERS

CROSS REFERENCE TO RELATED APPLICATION

This application is a continuation-in-part of co-pending application Ser. No. 516,140, filed July 21, 1983, now U.S. Pat. No. 4,569,800 incorporated herein by reference.

BACKGROUND OF THE INVENTION

The present invention pertains to novel compounds, particularly to quaternary ammonium salts, and most specifically to salts of a alkyl 2-ethylhexyl dimethylammonium chloride, where the alkyl group may be an aliphatic hydrocarbon having a carbon chain length of from about 6 to about 18, and to a fabric softening composition including this novel compound.

Quaternary ammonium salts are well known as fabric softening agents, and may be combined with solvents such as water or isopropyl alcohol to form dispersions that are suitable as fabric softening compositions. For example, U.S. Pat. No. 4,214,998, issued to Joy on July 29, 1980, and entitled "Quaternary Ammonium Compounds as Fabric Softening Agents," discloses a quaternary ammonium salt that includes an alkyl group having a somewhat longer chain length at the position corresponding to the 2-ethylhexyl branch of the present composition. Further, U.S. Pat. No. 3,803,137, issued to Egan et al on Apr. 8, 1974, and entitled "Mixtures of Aliphatic Amines and Quaternary Ammonium Compounds Thereof", discloses a blend of amines and quats having utility as fabric softeners. The 2-ethylhexyl branch of the present invention is not among the R groups disclosed in the Egan quaternaries. Finally, U.S. Pat. No. 4,341,644, issued to Bisschops et al on July 27, 1982, and entitled "Quaternary Ammonium Salt Mixtures", discloses quaternaries having alkyl groups that are longer than the present 2-ethyklhexyl group. Further, the Bisschops quats are only slightly dispersible in water, undergoing gelification at quat concentrations in excess of about 15%. See Bisschops, column 6, lines 64–68, and column 7, lines 1–4.

SUMMARY OF THE INVENTION

The present invention is a compound having the formula:

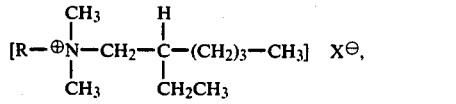

wherein R— is an aliphatic hydrocarbon radical having a carbon chain length of from about 6 to about 18, and $X^{\ominus}$ is $Cl^{\ominus}$, $I^{\ominus}$, $Br^{\ominus}$, or $OSO_3CH_3^{\ominus}$, otherwise known as alkyl 2-ethylhexyl dimethylammonium salts. The chloride salt finds utility in another aspect of the invention, a fabric softening compound forms a true solution and displays several surprising characteristics, including the aesthetically pleasing aspects of clarity and colorlessness at a temperature of 70° F. The most preferred solvents for the fabric softening compound are ethanol, water, isopropyl alcohol (isopropanol), or a blend of water and either or both of those alcohols.

Utilizing these solvents, the present fabric softening compounds may be used with good effect at solids concentrations of either 3% (wt.) or 6% (wt.). The rewet characteristics of fabrics treated with the compound at these concentrations are outstanding, and approach those of fabrics washed and rinsed in plain water.

Further, the present compounds may be used at weight ratios of the quat:solvent of 75:25 in isopropyl alcohol or water. Such 75:25 blends remain clear and colorless at 70° F., are a true solution rather than a dispersion, and demonstrate no gelification. As a result of this high concentration of active quaternary ingredient in the softening compound, the solids content of the compound is high and a much smaller amount of the compound in a rinse cycle will provide the same softening effect as a relatively large amount of a compound at a 3–6% quaternary concentration.

Particularly preferred forms of the compounds for use in fabric softening are the mixtures that result when the R— radical is included in one of the mixtures of radicals comprising the tallow or coco radicals. The tallow and coco radicals are mixtures of aliphatic hydrocarbon radicals having the following compositions (in liquid vol. %):

| No. of Carbons | 6 | 8 | 10 | 12 | 14 | 16 | 18 | 14' | 16' | 18' | 18" |
|---|---|---|---|---|---|---|---|---|---|---|---|
| Coco | .5 | 8 | 7 | 50 | 18 | 8 | 1.5 | | | 6 | 1 |
| Tallow | | | | 1 | 3 | 29 | 23 | 1 | 3 | 37 | 1.5 |

The superscrips ' and " conotate, one unsaturated and two unsaturated bonds respectively, per molecule.

In summary, fabric softeners made from the present novel composition demonstrate a unique combination of desirable softening compound characteristics, including high solids content, solubility and clarity and colorlessness at room temperature. The softeners impart to fabrics treated therewith excellent rewet and hand.

Thus, objects of the invention include the manufacture of a novel quaternary ammonium chloride and a superior fabric softening compound comprising the novel quat.

DESCRIPTION OF THE PREFERRED EMBODIMENT

The present novel compound may be manufactured in either of three preferred ways. The first preferred way is to treat an alkylamine having a carbon chain length of from about 6 to about 18 with 2-ethylhexanal at an elevated temperature and atmospheric pressure to form 2-ethyl hexilidine alkyl imine. Water is formed in this reaction, and the amount thereof is lowered to about 2% of the sum of the weights of the water and imine by heating at about 105° C. in the presence of nitrogen, which is gently blown through the reactor. The dried imine is heated to a temperature ranging from about slightly above room temperature to about 180° C. at 300–1000 psig hydrogen and in the presence of 0.2%–2.0% of a catalyst, the amount of catalyst being based upon the total weight of imine. After the heating is completed, the product comprises the secondary amine, alkyl 2-ethylhexyl amine. The present compound results when this secondary amine is methylated with two moles of methyl chloride per mole of amine in the presence of a solvent. Sodium bicarbonate or another base are used in the reaction so as to neutralize the hydrochloric acid formed in reaction.

The second preferred method for the manufacture of the present compound comprises reacting the alkylamine with 2-ethyl hexanal at a 1:1 molar ratio or with a slight excess of the aldehyde and in the presence of 0.2%-2.0% of a catalyst, the amount of catalyst being based upon the total weight of primary amine. The blend is reacted at a temperature between slightly above room temperature and 190° C., and at a hydrogen pressure of between 100 and 1000 psig. The secondary amine, alkyl 2-ethyhexylamine, in this second preferred method is produced notwithstanding the presence of water in the reaction mixture. The secondary amine is quaternized with methyl chloride, a solvent, and a base in the manner described hereinabove.

In a third and most preferred method, the secondary amine is made in accordance with the procedures set forth in the first or second preferred methods described hereinabove. The amine is reacted with methyl formcel (formaldehyde in methanol) in the presence of a catalyst and hydrogen to yield the tertiary amine, methyl alkyl 2-ethylhexylamine. The catalyst used in the conversion to the tertiary amine need not be added with the methyl formcel and hydrogen, as catalyst used in the conversion to the secondary amine is not separated therefrom after completion of that conversion. This catalyst in the secondary amine retains its catalytic effect in the reaction to the teriary amine. The tertiary amine can be quaternized with 1 mole of methyl chloride per mole of amine in the presence or absence of a solvent. The tertiary amine may also be quaternized with dimethyl sulfate or other known quaternizing reagents, such as diethylsulfate.

The following examples will demonstrate the manufacture of the present novel compounds in accordance with the above described preferred methods. Although the particular compounds manufactured have the tallow radical as a substituent, it is understood that the methods exemplified are equally efficacious when manufacturing compounds having aliphatic hydrocarbon radical substituents of lower carbon chain length, particularly the coco radical. The aliphatic hydrocarbon radical substituents may or may not be hydrogenated.

EXAMPLE 1

The first of the aforementioned preferred methods comprised adding 253.0 grams (0.945 gram moles) of Armeen ®T, a tallowamine manufactured by the Armak Company, 300 South Wacker Drive, Chicago, Ill. 60606, and 2% (molar) acetic acid to a one-liter, 3-necked round bottom flask equipped with mechanical stirring means, a Dean-Stark trap, an addition funnel, and a controlled heating mantle. The flask was heated until the contents were at 110° C., and 123.6 grams (0.945 gram moles) of 2-ethylhexanal were added thereto over the next one hour. In the interim, 10 ml of water were collected, and an additional 5.3 ml were collected over the next 1 hour and 50 minutes. Gas chromatographic analysis of the mixture disclosed about 92% tallowalkyl 2-ethylhexylimine.

Three hundred and fifty-three grams of this imine, used as a reactant, and 3.5 g. of 5132P Harshaw nickel catalyst were placed in a one-liter Parr autoclave having a nitrogen purge line connected thereto. The reactor was purged with 50 psig (hydrogen) and then vented six times in succession. The contents were heated to and maintained at 150° C. in the reactor, which was pressurized with 600 psig hydrogen. After 1 hour and 20 minutes at this temperature and pressure gas chromatographic analysis indicated about 73% tallow 2-ethylhexylamine, about 20% di(2-ethylhexyl)amine, and 7% of the imine reactant.

Two hundred and seventy-one and one-half grams (0.698 gram moles) of this amine, 79.1 grams of the solvent isopropyl alcohol, 76.2 grams of sodium bicarbonate ($NaHCO_3$), 2.0 grams of sodium bisulfite ($NaHSO_3$), and 54 mg of the color stabilizing agent Dissolvine ®NA2, which is a trademark for a brand of an EDTA-disodium salt, and which is manufactured by Akzo Chemie, Stationsstraat 48, Amersfoort, The Netherlands, were added to a one-liter Paar autoclave made of Carpenter 20/E alloy. The autoclave or reactor was communicative through a nitrogen purge line with a one-liter 316 stainless steel bomb, and the reactor was purged twice with nitrogen. The autoclave's contents were heated to 100° C., and then methyl chloride was added to the reactor until a pressure of 175 psig was attained. As the methylation proceeded over the next ninety minutes, the reactor pressure built and had to be relieved occasionally by venting to 200 psig. At ninety minutes after the introduction of the methyl chloride, the reactor was vented to 100 psig, closed again, and the additional methyl chloride added until a pressure of 180 psig was attained. After an additional five and one-half hours, the reaction had gone essentially to completion. An analysis of the reactor contents indicated that 8.3% free amine and 2.1% amine hydrochloride salt remained in the mix. The rest of the product was primarily the present novel compound, tallowalkyl 2-ethylhexyl dimethylammonium chloride.

EXAMPLE 2

In this second of the preferred methods, 341.9 grams of Armeen ®TMD aliphatic amine, Armak's distilled-grade tallowamine, and 1.7 grams (0.5% (wt.) of the amine) of a palladium on carbon catalyst were added to a one-liter Parr autoclave. The reactor was then purged by pressurization with nitrogen and vented three times in succession. The pressure of the autoclave was checked and thereafter the autoclave was pressurized with nitrogen and vented twice more. Finally, the contents were heated to 135° C. and with the reactor pressurized to 300 psig with $H_2$, 2-ethylhexanal was added gradually and at a substantially uniform rate over the next three hours. The reaction mixture was permitted to digest over the next half hour, at which time gas chromatographic analysis disclosed 94.12% conversion to the secondary amine, tallowalkyl 2-ethylhexylamine, with approximately 2.54% remaining as unreacted primary amine and 1.25% conversion to the tertiary amine. The mixture was allowed to digest for several more hours at 135° C., and the reactor pressure increased to 400 psig with hydrogen as necessary. Upon discharge of the mixture from the reactor the following day, the water therein was visually distinct and separated, and the remaining product was filtered. The filtrate was substantially all tallowalkyl 2-ethylhexylamine, which was methylated to form the present novel quaternary ammonium chloride in accordance with the methylation procedure set forth hereinabove at Example 1.

EXAMPLE 3

As an example of the third and most preferred method, tallow 2-ethylhexylamine was manufactured in accordance with the procedures set forth in Example 2 above, and then methylated with methyl formcel.

For example, 695 grams (2.653 gram moles) of Armeen ®TMD aliphatic amine, Armak's trademark for primary distilled tallowamine, and 3.4 grams of a palladium on carbon catalyst were charged to a one-liter Parr stainless steel autoclave communicative with a 500 ml buret having a Milroyal pump. After purging and venting the reactor several times with 50 psig nitrogen, its contents were heated to 134° C. and pressurized with hydrogen to 300 psig. Over the next 3 hours and 27 minutes, 439 ml (360 grams, 2.81 gram moles) of 2-ethylhexanal were pumped into the reactor. Gas chromatographic analysis of the reactor contents 30 minutes later indicated that 87.8% of the mixture was the secondary amine, tallowalkyl 2-ethylhexylamine. Over the next 1 hour and 12 minutes, with the mixture still at 135° C. and 300 psig hydrogen pressure, 155 ml (164 grams, 3.01 gram moles) of methyl formcel (a mix of 55% formaldehyde and 45% methanol) were pumped into the reactor. Analysis disclosed no primary or secondary amine and 93.6% of the tertiary amine, tallowalkyl methyl 2-ethylhexylamine.

This tertiary amine may be quaternized with methyl chloride in the presence or absence of a solvent. For example, 271 grams of the tertiary amine and 54.2 grams (20% of the weight of the amine) of sodium bicarbonate was charged to a nitrogen-purged reactor and heated to 100° C., then treated with an excess of 200 psig methyl chloride for about 9 hours and 30 minutes. Analysis of the reaction mixture indicated about 1.4% of the amine salt, 0.9% of the free amine, and 93.7% of the present quaternary ammonium chloride.

In contrast, the tertiary amine may be methylated in the presence of a solvent. For example 326 grams (0.784 gram moles) of the amine, were added to 91.4 grams of the solvent isopropanol, and 32 grams of sodium bicarbonate in a nitrogen-purged reactor, the contents were heated to 100° C., and 200 psig methyl chloride were added for the next 3 hours and 15 minutes. Sampling and analysis at the end of the methylation indicated 4.7% free amine and 0.3% ammonium hydrochloride salt. The balance was essentially entirely comprised of the present quaternary ammonium chloride.

EXAMPLE 4

This example will demonstrate significant and in many cases unexpectedly good properties of the present novel compounds and of the present compositions including those compounds. The compositions first prepared were 3% (solids) and 6% (solids) aqueous solution made by blending tallowalkyl dimethyl 2-ethylhexylammonium chloride with hot water. For example, a 3.0% solids formulation was prepared by blending 24.29 grams of the present compound as disclosed in Example 1, which has a solids content of 74.1%, with 575.71 grams of hot water. This composition and several others like it were prepared, the only differences being the selection of the particular compound. Each compound used had a solids content of from 70.2 to 75.0% and a free amine content of from 2.3 to 8.5%. Also prepared was a composition in 4.5% (solids) concentration in water of cocoalkyl dimethyl 2-ethylhexylammonium chloride (Arquad ®CL8).

The efficacy of the softener compositions was evaluated by an experienced panel of persons touch-testing both treated fabrics and untreated control fabrics and comparing their respective softness. Nylon, polyester, and 65% polyester/35% cotton (65/35 P/C) fabrics were evaluated after both 1 and 5 wash-dry cycles, the treated fabrics having been treated with a softener during each wash cycle. The control fabrics were washed and dried one and five times without using a softening agent. Further, other samples of these same fabrics were washed and dried in the same manner in 3.0% and 6.0% (solids) solutions of the prior art softeners Varisoft-222 and also in Arquad ®2T-75 and Arquad ®2HT-75 quaternary ammonium chlorides. Varisoft is the brand name for a softener manufactured by the Sherex Chemical Corporation, Dublin, Ohio, and the Arquad ® quaternary ammoniun chlorides are manufactured by the Akzo Chemie America's Armak Chemicals Division, 300 S. Wacker Drive, Chicago, Ill. 60606. Each of sixty panelists touch-tested each of the two treated and one untreated control fabrics after one wash-dry cycle and five wash-dry cycles, and awarded one point to that fabric that was softest to his touch and zero points to the other two fabrics. The compositions of the present invention were found to significantly soften the fabrics tested when compared to untreated fabrics and were found to be as effective as the prior art softeners.

In addition, the rewet of fabrics treated with the present compositions and the prior art compositions cited hereinabove was evaluated. Rewet is a measure of a fabric's adsorbency, and is determined by measuring the height to which water rises in a strip of fabric having one end immersed in dyed water. About one inch of a 2"×18" cotton strip is suspended into a 3" depth of a 0.1% solution of Drimarene Bordeaux Z-BL dye contained in a one liter graduated glass cylinder. The height to which the dyed water has been absorbed may be visually ascertained, and is measured at 5, 10, 20, and 30 minutes. The results are determined by averaging duplicate samples.

The present compositions will also increase the antistatic properties of the fabric. The antisatic characteristics were measured by comparing the static ("cling" tendency) properties of treated fabrics with untreated fabrics. The treated fabrics were given a rating relative to one chosen aribitrarily for the control. For nylon control fabrics, a rating of 10 is given; for 100% polyester control fabrics, a rating of 8 is given; and for a 65/35 polyester/cotton fabric a rating of 5 is given. A rating for the softener-treated fabric that is numerically less than that for the control indicates that the softener imparts antistatic characteristics to the fabric; the larger the difference in the ratings, the better the antistat effect imparted by that particular softener.

The results of the softening, rewet, and antistat tests are recorded in Tables 1–6:

TABLE 1

Comparison of softening, rewet, and antistat characteristics of 3% solution of hydrogenated tallow 2-ethylhexyl quaternary ammonium chloride (HTL8-1470-134) vs. 3% dispersion of Varisoft-222

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| HTL8-1470-134 (Ni catalyst) | 28 | 37 | 5 | 5 | 4 | 4 |
| Varisoft-222 | 20 | 23 | 6.3 | 5 | 3 | 4 |

TABLE 1-continued

Comparison of softening, rewet, and antistat characteristics of 3% solution of hydrogenated tallow 2-ethylhexyl quaternary ammonium chloride (HTL8-1470-134) vs. 3% dispersion of Varisoft-222

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| Control | 12 | 0 | 17.8 | 10 | 5 | 8 |

TABLE 2

Comparison of softening, rewet, and antistat characteristics of 3% solution of hydrogenated tallow 2-ethylhexyl quaternary ammonium chloride (HTL8-1491-57) vs. 3% dispersion of Varisoft-222

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| HTL8-1491-57 (palladium catalyst) | 26 | 38 | 22 | 1 | 2 | 2 |
| Varisoft-222 | 18 | 18 | 14 | 8 | 3 | 4 |
| Control | 18 | 4 | 22 | 10 | 5 | 8 |

TABLE 3

Comparison of softening, rewet, and antistat characteristics of 6% solution of hydrogenated tallow 2-ethylhexyl quaternary ammonium chloride (HTL8-1456-107) vs. 6% dispersion of Arquad ® 2T quaternary ammonium chloride (lot no. 6030000-9).

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| HTL8-1456-107 | 23 | 31 | 22.0 | 2 | 1 | 2 |
| Arquad ® 2T | 30 | 25 | 8.5 | 1 | 1 | 2 |
| Control | 7 | 4 | 22.5 | 10 | 5 | 8 |

TABLE 4

Comparison of softening, rewet, and antistat characteristics of 6% solution of hydrogenated tallow 2-ethylhexyl quaternary ammonium chloride (HTL8-1456-135) vs. 6% dispersion of Arquad ® 2HT quaternary ammonium chloride (lot no. 7215903)

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| HTL8-1456-135 | 26 | 27 | 21.0 | 3 | 1 | 3 |
| Arquad ® 2HT | 32 | 29 | 4.5 | 2 | 1 | 3 |
| Control | 2 | 4 | 23.0 | 10 | 5 | 8 |

TABLE 5

Comparison of softening, rewet, and antistat characteristics of 4.5% solution of hydrogenated cocoalkyl dimethyl 2-ethylhexylammonium chloride (Arquad ® CL8) vs. 4.5% dispersion of Varisoft-222

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| Arquad ® CL8 | 28 | 32 | 19.1 | 6 | 1 | 4 |
| Varisoft-222 | 12 | 25 | 15.2 | 10 | 2 | 3 |
| Control | 20 | 3 | 17.1 | 10 | 5 | 8 |

TABLE 6

Comparison of softening, rewet, and antistat characteristics of 4.5% solution of hydrogenated cocoalkyl dimethyl 2-ethylhexylammonium chloride (Arquad ® CL8) vs. 4.5% dispersion of Arquad ® 2HT

| | Softening, after indicated number of wash-dry cycles | | Rewet, cm. | 100% | 65/35 | 100% |
|---|---|---|---|---|---|---|
| | 1 | 5 | after 30 min. | nylon | P/C | Polyester |
| Arquad ® CL8 | 37 | 28 | 19.1 | 6 | 1 | 4 |
| Arquad ® 2HT | 18 | 28 | 8.9 | 3 | 1 | 3 |
| Control | 5 | 4 | 17.1 | 10 | 5 | 8 |

Softening, antistat, and rewet comparisons between 6% (solids) water solutions of the hydrogenated tallow 2-ethylhexyl quaternary ammonium chloride embodiment of the present compounds and 6% (solids) water solutions or dispersions of structurally similar compounds were made in accordance with the testing procedure described hereinabove. The structurally similar compounds included tallow n-butyl dimethyl quaternary ammonium chloride, hereinafter referred to as 4T; tallow isobutyl dimethyl quaternary ammonium chloride (L4T); tallow hexyl dimethyl quaternary ammonium chloride (6T); tallow octyldimethyl quaternary ammonium chloride (HT8); hydrogenated tallow 1-methylheptyl dimethyl quaternary ammonium chloride (MHTK8); and docosanyl ($C_{22}$ alkyl radical) 2-ethylhexyl quaternary ammonium chloride (L8HF). The results of the comparisons are set forth in Table 7:

TABLE 7

Softening and antistat comparisons of present compound and similar compositions. (All compounds demonstrated excellent rewet)

| | Softening | | Antistat | | |
|---|---|---|---|---|---|
| | 1 cycle | 5 cycles | 100% Nylon | 65/35 P/C | 100% Polyester |
| HTL8 | 30 | 39 | 2 | 1 | 2 |
| 4T | 20 | 14 | 3 | 1 | 2 |
| Control | 10 | 7 | 10 | 5 | 8 |
| HTL8 | 30 | 36 | 2 | 1 | 2 |
| L4T | 19 | 23 | 2 | 3 | 3 |
| Control | 11 | 1 | 10 | 5 | 8 |
| HTL8 | 29 | 37 | 2 | 1 | 2 |
| 6T | 24 | 21 | 7 | 1 | 3 |
| Control | 7 | 2 | 10 | 5 | 8 |
| HTL8 | 27 | 31 | 2 | 1 | 2 |
| HT8 | 27 | 23 | 3 | 1 | 2 |
| Control | 6 | 6 | 10 | 5 | 8 |
| HTL8 | 31 | 35 | 2 | 1 | 2 |
| MHTK8 | 21 | 23 | 5 | 2 | 2 |
| Control | 8 | 2 | 10 | 5 | 8 |
| HTL8 | 39 | 39 | 2 | 1 | 2 |
| L8HF | 10 | 10 | 3 | 3 | 6 |
| Control | 11 | 11 | 10 | 5 | 8 |

Further, the present compounds and the above structurally similar compounds were tested for water solubility. The isopropanol solvent in each was stripped off to leave a residue, and to this residue was added sufficient water so as to comprise 10–20% of the total weight of the water-residue blend.

When water was added to 4T, L4T, 6T, HFL8, at room temperature, the blend did not form a solution and instead formed either a solid or gel. The compounds were dispersible in the above-noted proportions at elevated temperatures, but became gels or solids upon cooling to room temperature.

When water was added to HT8 and MHTK8 at room temperature, thick, non-flowing gels formed. The gels became homogeneous fluids upon heating.

In contrast, hydrogenated tallow and coco 2-ethylhexyl quaternary ammonium chloride was soluble in all proportions of water:quat, at both room temperature and elevated temperatures. In all proportions and at all temperatures tested, the solutions were clear and colorless.

Cloud point and pour points were determined for the present compounds and the above-mentioned structurally similar compounds. These results are set forth in Table 8 and indicate that the present compounds are equal to or superior to all others tested. The cloud point is a particularly important criterion in that clarity of the softener at a given temperature is directly related thereto.

TABLE 8

Pour points (°F.) and cloud points (°F.) of the present compounds and structurally similar compounds, 75% solids in isopropanol.

| Composition | Branched (B) or Unbranched (U) | Pour pt., °F. | Cloud pt., °F. |
|---|---|---|---|
| 4T | U | 61 | 69 |
| 4LT | B | 45 | 50 |
| 6T | U | 63 | 65 |
| HT8 | U | 33 | 42 |
| HFL8 | B | 60 | 64 |
| HTL8 | B | 23 | 27 |
| MHTK8 | B | 22 | 26 |
| Arquad ® CL8 | B | −37 | −10 |

It was noted that MHTK8 did not prove to be as effective a softener as the present compositions.

Further advantages of the present compounds, in addition to their excellent solubility in water, ethanol, isopropanol, or a blend of water and either or both alcohols, include their clarity and colorlessness in solution. Prior art softeners at concentrations as low as 3% are opaque, colored suspensions rather than solutions, typically having a light blue or pink hue. In order to keep these prior art softeners in suspension, only about 3–15% of the active ingredient (solids content) is placed in 85–97% solvent; at levels above about 15% conventional quats in water solvents undergo gelification. See Bisschops, cited hereinabove, col. 6, lines 64–68, and col. 7, lines 1–4. Thus, the solvent is a large part of the softening compound and a relatively large quantity of this compound must be added to the rinse water to provide a given level of solids therein, the solids being a relatively minor part of the softening compound.

In contrast, the present compounds form softening compositions that are true solutions and that are clear and colorless at room temperature at any ratio of composition to solvent, and which still exhibit rewet and softening properties comparable to and frequently superior to those of prior art compositions. The present compositions are clear liquid at room temperature even when the solvent is not pure isopropanol, and have a much lower cloud and pour point than structurally similar compositions.

What is claimed is:

1. A compound having the formula:

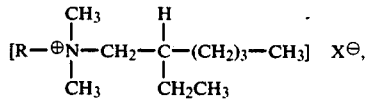

wherein R— is an aliphatic hydrocarbon radical having a carbon chain length of from about 6 to about 18, and $X^{\ominus}$ is $Cl^{\ominus}$, $I^{\ominus}$, $Br^{\ominus}$, or $OSO_3CH_3^{\ominus}$.

2. A fabric softening composition, comprising at least 3% (wt.) of the compound:

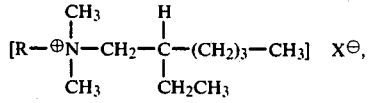

wherein R— is an aliphatic hydrocarbon radical having a carbon chain length of from about 6 to about 18, and $X^{\ominus}$ is $Cl^{\ominus}$, $I^{\ominus}$, $Br^{\ominus}$, or $OSO_3CH_3^{\ominus}$ and wherein said composition is soluble in a solvent to form said composition which is a true solution of said compound and said solvent, said composition being clear and colorless at 70° F.

3. The composition as set forth in claim 2, wherein said solvent is selected from the group including ethanol, water, isopropyl alcohol, or blends thereof.

4. The composition as set forth in claim 2, wherein said compound has a solids content of at least 3.0% (wt.).

5. The composition as set forth in claim 3, wherein said compound has a solids content of at least 3.0% (wt.).

6. The composition as set forth in claim 2, wherein said compound has a solids content of at least 6.0% (wt.).

7. The composition as set forth in claim 3, wherein said compound has a solids content of at least 6.0% (wt.).

8. The composition as set forth in claim 2, wherein the weight ratio of said composition to said solvent is at least 75:25.

9. The composition as set forth in claim 8, wherein said solvent is isopropyl alcohol.

10. The compound of claim 1 wherein said aliphatic hydrocarbon is hydrogenated.

11. The composition of claim 2 wherein said aliphatic hydrocarbon is hydrogenated.

12. The compound of claim 1 wherein R is the coco radical.

13. The composition of claim 2 wherein R is the coco radical.

* * * * *